US006598701B1

(12) United States Patent
Wood et al.

(10) Patent No.: US 6,598,701 B1
(45) Date of Patent: Jul. 29, 2003

(54) SHAPED MICROPERFORATED POLYMERIC FILM SOUND ABSORBERS AND METHODS OF MANUFACTURING THE SAME

(75) Inventors: Kenneth B. Wood, St. Paul, MN (US); Paul A. Martinson, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/607,485

(22) Filed: Jun. 30, 2000

(51) Int. Cl.[7] ..... E04B 1/82

(52) U.S. Cl. ..... 181/290; 181/284; 181/286; 181/292; 181/294

(58) Field of Search ..... 181/284, 286, 181/290, 292, 294, 296

(56) References Cited

U.S. PATENT DOCUMENTS

| | | | | |
|---|---|---|---|---|
| 3,621,934 A | | 11/1971 | Thrasher et al. | 181/290 |
| 3,782,495 A | | 1/1974 | Nassof | 181/284 |
| 3,893,640 A | * | 7/1975 | Hult, Jr. et al. | 244/54 |
| 4,097,633 A | | 6/1978 | Focht | 428/138 |
| 4,118,531 A | | 10/1978 | Hauser | 442/344 |
| 4,287,962 A | | 9/1981 | Ingard et al. | 181/224 |
| 4,755,416 A | | 7/1988 | Schneider et al. | 428/167 |
| 4,825,974 A | * | 5/1989 | Hoffmann et al. | 181/290 |
| 5,298,694 A | | 3/1994 | Thompson et al. | 181/286 |
| 5,459,291 A | | 10/1995 | Haines et al. | 181/286 |
| 5,550,338 A | * | 8/1996 | Hielscher | |
| 5,560,967 A | | 10/1996 | Isaksen | 428/71 |
| 5,653,386 A | | 8/1997 | Hennessee et al. | 237/12.3 B |
| 5,653,836 A | | 8/1997 | Mnich et al. | 156/98 |
| 5,657,582 A | * | 8/1997 | Chitwood | 52/16 |
| 5,700,527 A | | 12/1997 | Fuchs et al. | 428/34.4 |

(List continued on next page.)

FOREIGN PATENT DOCUMENTS

| | | |
|---|---|---|
| DE | 43 16 843 A1 | 11/1994 |
| DE | 43 34 984 C1 | 1/1995 |
| DE | 198 38 766 C1 | 2/2000 |
| EP | 0454949 A | 6/1991 |
| EP | 0 441 759 A1 | 8/1991 |
| EP | 0584442 | 2/1994 |
| EP | 0 816 583 B1 | 4/2001 |
| WO | WO 00/05707 | 2/2000 |

OTHER PUBLICATIONS

Ingard, K. U., "Acoutic visco–thermal effects," *Notes on Sound Absorption Technology, Chapter 2*, pp. 2–1 through 2–35 and E–37, copyright 1994 (no month available).

Maa, D.Y., "Microperforated–Panel Wideband Absorbers," *Noise Control Engineering Journal*, vol. 29, No. 3, pp. 77–84 (Nov.–Dec., 1987).

Wu, M.Q., "Micro–Perforated Panels for Duct Silencing," *Noise Control Engineering Journal*, vol. 45, No. 2, pp. 69–77 (Mar.–Apr., 1997).

Rodriguez, "Principles of Polymer Systems," 2nd Edition, title page and pp. 373–376.

*Primary Examiner*—Shih-Yung Hsieh
(74) *Attorney, Agent, or Firm*—Stephen W. Buckingham

(57) ABSTRACT

Shaped, microperforated sound absorbers and methods of making the same are herein provided. In one embodiment, the sound absorber is produced from a polymeric, typically plastic, film having a series of microperforations formed over all or a portion of the film surface. The film is then formed to produce the desired three-dimensional shape. The depth of the three-dimensional shape is controlled to provide the desired cavity depth which, in turn, influences the sound absorption spectrum. After forming, the three-dimensional shape is maintained without the need for additional supports or frames. Deformation of the microperforations due to the forming process does not substantially interfere with the sound absorption properties of the film. Further, film resonance over largely unsupported portions also has little effect on the sound absorption spectrum.

57 Claims, 9 Drawing Sheets

U.S. PATENT DOCUMENTS 5,741,456 A * 4/1998 Ayrton ..... 264/400
5,807,628 A 9/1998 Mnich et al. ..... 428/314.2
5,841,081 A 11/1998 Thompson et al. ..... 181/286
5,923,002 A * 7/1999 McGrath et al. ..... 181/290
5,962,107 A 10/1999 Lowery et al. ..... 428/131
6,021,612 A * 2/2000 Dunn et al. ..... 52/144
6,145,617 A * 11/2000 Alts ..... 181/290
6,209,680 B1 * 4/2001 Perdue ..... 181/295

* cited by examiner

SHAPED MICROPERFORATED POLYMERIC FILM SOUND ABSORBERS AND METHODS OF MANUFACTURING THE SAME

FIELD OF THE INVENTION

The present invention relates generally to sound absorption systems and, more particularly, to both three-dimensionally-shaped, microperforated polymeric sound absorbers and methods of manufacturing the same.

BACKGROUND

Sound absorbers are in widespread use in a number of different applications. While various configurations are known, one common sound absorber design utilizes one or more layers of fibrous material to dissipate sound wave energy. Such fiber-based absorbers may include, for example, fiberglass strands, open-cell polymeric foams, fibrous spray-on materials such as polyurethanes, and acoustic tiles (agglomerated fibrous and/or particulate matter). These materials permit the frictional dissipation of sound energy within the interstitial voids of the sound absorbing material. While such fiber-based absorbers are advantageous in that they are effective over a broad acoustic spectrum, they have inherent disadvantages. For instance, these sound absorbers can release particulate matter, degrading the surrounding air quality. In addition, some fiber-based sound absorbers do not possess sufficient resistance to heat or fire. They are therefore often limited in application or, alternatively, must undergo additional and sometimes costly treatment to provide desirable heat/flame resistance.

Another type of sound absorber utilizes perforated sheets, such as relatively thick metal having perforations of large diameter. These sheets may be used alone with a reflective surface to provide narrow band sound absorption for relatively tonal sounds. Alternatively, these perforated sheets may be used as a facing overlying a fibrous sound absorber to improve sound absorption over a wider acoustic spectrum. In addition to their own absorbing properties, the perforated sheets also serve to protect the fiber-material. However, these "two-piece" sound absorbers are limited in application due to their cost and relative complexity.

Perforated, sheet-based sound absorbers have also been suggested for sound absorption. Conventional perforated, sheet-based sound absorbers may use either relatively thick (e.g., greater than 2 mm) and stiff perforated sheets of metal or glass or thinner perforated sheets which are externally supported or stiffened with reinforcing strips to eliminate vibration of the sheet when subject to incident sound waves.

Fuchs (U.S. Pat. No. 5,700,527), for example, te aches a sound absorber using relatively thick and stiff perforated sheets of 2–20 mm thick glass or synthetic glass. Fuchs suggests using thinner sheets (e.g., 0.2 mm thick) of relatively stiff synthetic glass provided that the sheets are reinforced with thickening or glued-on strips in such a manner that incident sound cannot cause the sheets to vibrate. In this case, the thin, reinforced sheet is positioned away from an underlying reflective surface.

Mnich (U.S. Pat. No. 5,653,386) teaches a method of repairing sound attenuation structures for aircraft engines. The sound attenuation structures commonly include an aluminum honeycomb core having an imperforate backing sheet adhered to one side, a perforate sheet of aluminum adhered to the other side, and a porous wire cloth adhesively bonded to the perforated aluminum sheet. According to Mnich, the sound attenuation structure may be repaired by removing a damaged portion of the wire cloth and adhesively bonding a microperforated plastic sheet to the underlying perforated aluminum sheet. In this manner, the microperforated plastic sheet is externally supported by the perforated aluminum sheet to form a composite, laminated structure which provides similar sound absorption as the original wire cloth/perforated sheet laminated structure.

While these perforated and microperforated sheet-based sound absorbers may overcome some of the inherent disadvantages of their fiber-based counterparts, they are expensive and/or of limited use. For instance, very thick and/or very stiff sound absorbers or those which require external support e.g., thickening strips, are costly and complex when compared to fiber-based sound absorbers.

Another problem inherent with fiber-based and conventional perforated sound absorbers involves applications in non-planar configurations, i.e., applications that require sound absorbers having three-dimensional rather than planar shapes. In particular, fiber-based sound absorbers generally require external support to maintain such non-planar, three-dimensional configurations. Perforated sheet-based sound absorbers, on the other hand, are heavy and typically require expensive forming equipment to produce three-dimensional shapes.

Yet another drawback with conventional, perforated sound absorbers is that the perforated sheet may require expensive, narrow diameter perforations for applications involving other than absorption of tonal sound. For instance, to achieve broad-band sound absorption, conventional perforated sheets must be provided with perforations having high aspect ratios (hole depth to hole diameter ratios). However, known punching, stamping, and laser drilling techniques used to form such small hole diameters are relatively expensive.

SUMMARY

Accordingly, the present invention provides a shaped, broad-band sound absorber that is inexpensive to produce, yet applicable across a wide range of applications. More particularly, the present invention provides polymeric film sound absorbers having non-planar, three-dimensional shapes and methods of producing such sound absorbers.

A sound absorbing body in accordance with one embodiment of the present invention includes a polymeric film having first and second major surfaces and a plurality of microperforations extending between the first and second major surfaces. A three-dimensional shape is formed by the polymeric film. The three-dimensional shape has an interior surface and an exterior surface wherein the interior surface defines a volume.

In another embodiment, a sound absorbing body is provided including a polymeric film having first and second major surfaces and a plurality of microperforations extending between the first and second major surfaces. A three-dimensional shape formed by the polymeric film is also provided. The three-dimensional shape includes an interior surface and an exterior surface, wherein the interior surface defines a volume of the three-dimensional shape. In response to incident soundwaves at a particular frequency in the audible frequency spectrum, the sound absorbing body absorbs at least a portion of the incident soundwaves. At least a portion of the three-dimensional shape may vibrate in response to the incident soundwaves.

In yet another embodiment, a sound absorbing body is provided having a polymeric film with first and second major surfaces. The body further includes a plurality of microperforations extending between the first and second major surfaces of the polymeric film, and a three-dimensional shape formed by the polymeric film. The three-dimensional shape includes an interior surface and an exterior surface, wherein the interior surface defines a volume of the three-dimensional shape. A fibrous sound absorbing material proximate the polymeric film is also included.

In still yet another embodiment of the invention, a method of manufacturing a sound absorbing body is provided. The method includes providing a sheet of polymeric film having first and second major surfaces, wherein the polymeric film has a plurality of microperforations extending between the first and second major surfaces. The method further includes deforming the sheet to form a three-dimensional shape where the three-dimensional shape includes an interior surface and an exterior surface, the interior surface defining a volume of the three-dimensional shape.

Although briefly summarized here, the invention can best be understood by reference to the drawings and the description of the embodiments which follow.

BRIEF DESCRIPTION OF THE DRAWINGS

The invention will be further described with reference to the drawings wherein like reference characters indicate like parts throughout the several views, and wherein.

DETAILED DESCRIPTION OF EXEMPLARY EMBODIMENTS

In the following detailed description of the embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Generally speaking, the present invention is directed to microperforated, polymeric films that are formed into three-dimensional shapes for use as sound absorbers. The three-dimensional shape is achieved and maintained without the need for external supports or supplemental shaping elements.

The sound absorbers of the present invention are intended for a wide range of acoustic applications such as, for example, automobile door panels and the like, and household appliances such as washing machines, for example. However, the ability to produce a wide array of three-dimensional shapes makes absorbers and methods of the present invention adaptable to most any sound absorbing application.

Figure 1:
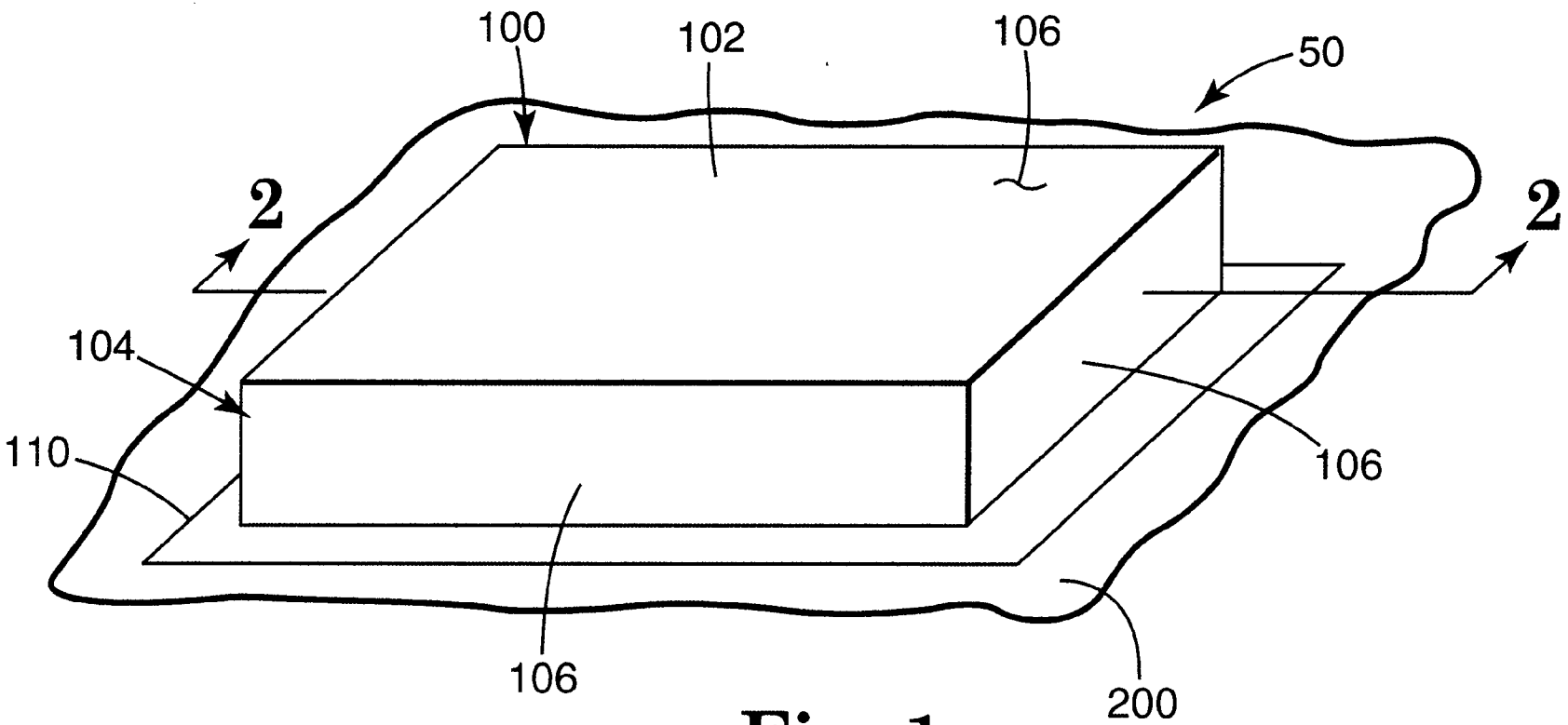
FIG. 1 is perspective view of a sound absorbing system in accordance with one embodiment of the invention.

FIG. 1 is a perspective view of a sound absorbing system 50 including a sound absorbing body 100 and a sound reflecting surface 200. The sound absorbing body 100, in one embodiment, may be formed from a single continuous sheet of microperforated, polymeric film 102 that is molded or otherwise formed to produce a three-dimensional shape 104. The three-dimensional shape 104 may be defined by one or more exterior surfaces 106 and one or more interior surfaces 108 (see FIG. 2). While the three-dimensional shape 104 is illustrated in FIG. 1 and described herein as generally box shaped, this is not to be interpreted as limiting as other embodiments having most any shape are possible. Further, the film 102 may be formed into a sound absorbing body 100 comprising a single three-dimensional shape as shown in FIG. 1 or, alternatively, into numerous three-dimensional shapes of the same or different size. Examples of such alternative embodiments are described in more detail below.

Figure 2:
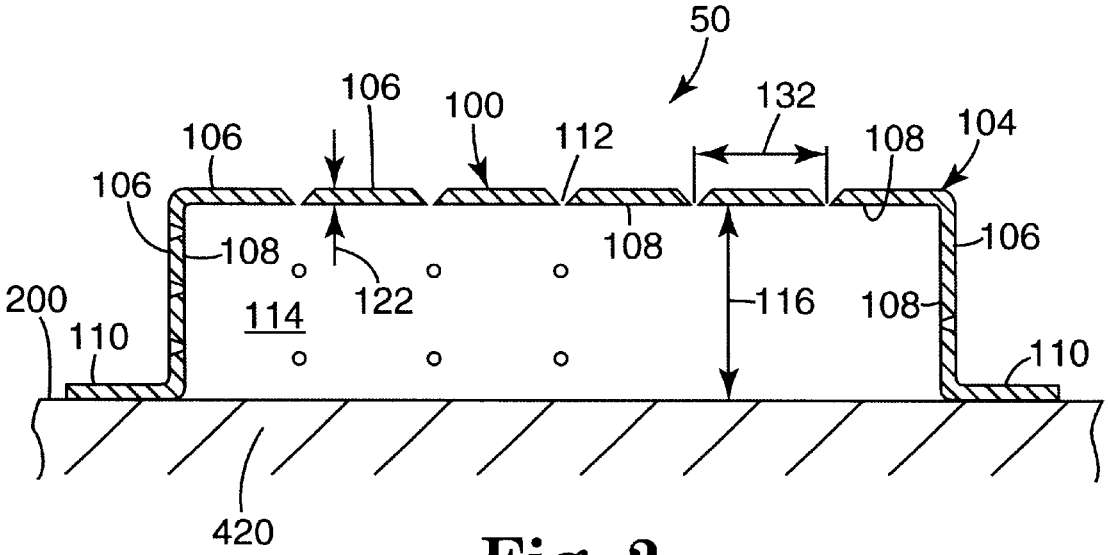
FIG. 2 is a cross-section view taken along line 2—2 of FIG. 1.

FIG. 2 is a cross section taken along line 2—2 of FIG. 1. As evident in this view, microperforations 112 (also referred to hereinafter as "holes" or "perforations") extend through the film 102 from the exterior surface 106 to the interior surface 108. In this view, the microperforations 112 are shown enlarged for clarity, e.g., they are shown overly large in comparison to the sheet 102. In practice, actual microperforation size is much smaller and the density much greater than that generally represented in the accompanying figures.

Still referring to FIG. 2, the interior surfaces 108 of the sound absorbing body 100 define a cavity or volume 114. The volume 114 may be further defined and may preferably be enclosed by the reflecting surface 200. The volume has a depth 116 that is herein generally defined as the distance from the interior surface 108 to the reflective surface 200. Where the reflecting surface 200 and opposing interior surface 108 are planar and parallel, the depth 116 is constant. However, where one or more of the surfaces 200 and 108 are non-planar or planar but skewed from the other, the depth 116 may vary.

To assist in coupling or otherwise securing the sound absorbing body 100 to the reflecting surface 200, the three-dimensional shape 104 is preferably formed with coupling portions, e.g., flanges 110. The flanges 110 may be used to secure the sound absorbing body 100 to the reflecting surface 200 via an adhesive (e.g., two-sided, adhesive tape, epoxy, etc.), ultrasonic weld, or other attachment method. When so secured, a sound absorbing system 50 is formed wherein the volume 114 is preferably enclosed by the sound absorbing body 100 and the reflecting surface 200. Other embodiments where the volume is not enclosed, i.e., the sound absorbing body 100 does not couple to the reflecting surface 200, are also possible.

When exposed to acoustic energy waves, "plugs" of air within the microperforations 112 vibrate. As the air vibrates, sound energy is dissipated via frictional interaction of the moving air with the walls of the microperforations 112.

Many factors including the microperforation size, sheet material, sheet thickness, and depth 116 of the volume 114 influence the particular acoustic absorption properties of the sound absorber 100.

Sound absorbers in accordance with the present invention permit the formation of three-dimensional shapes adapted for use in sound absorbing applications having non-planar reflecting surfaces or, alternatively, in applications where a non-uniform cavity depth 116 is desired (e.g., shaped absorber and planar reflective surface). Further, the formation of the three-dimensional shapes is achieved without the need for reinforcing or thickening strips or other supports.

With this general overview, a discussion of particular aspects of sound absorbers and methods of the present invention is now provided. In particular, preferred microperforated polymeric films and methods for forming the three-dimensional shapes are described.

Microperforated Polymeric Films

In general, the three-dimensional shape 104 (see FIGS. 1 and 2) is produced by post-forming a generally planar and continuous polymeric sheet, e.g., film 102, having microperforations 112 therein. While not central to the present invention, films 102 and methods of producing the films will now be described. For a more detailed discussion, see published PCT Application No. PCT/US99/00987 (international publication number WO 00/05707), filed Jan. 18, 1999, and entitled "Microperforated Polymeric Film for Sound Absorption and Sound Absorber Using Same."

Referring still to FIG. 2, a sound absorbing body 100 (also referred to herein as a "sound absorber") using a relatively thin and flexible microperforated polymeric film in accordance with one embodiment of the invention is illustrated. The film 102 is typically formed from a solid, continuous polymeric material which is substantially free of any porosity, interstitial spaces, or tortuous-path spaces. The film typically has a bending stiffness of about $10^6$ to about $10^7$ dyne-cm or less and a thickness less than about 80 mils (2 mm) and more preferably about 30 mils (0.75 mm) or less. The type of polymer as well as the specific physical characteristics (e.g., thickness, bending stiffness, surface density, hole diameter, hole spacing, and hole shape) of the film 102 may vary without departing from the scope of the invention. Preferably, the film 102 has a substantially uniform thickness (before post-forming) with the exception of possible variations in the vicinity of the microperforations that may result from the forming process.

As already stated, a number of factors affect the sound absorption characteristics of the sound absorber 100. For example, cavity depth 116 (see FIG. 2) and properties/geometry of the reflective surface 200 may alter absorption properties. In addition, aspects of the microperforated film 102 including, for example, physical properties of the film material, geometry of the film, the shape of the holes 112, and the hole spacing 132 may all influence the sound absorption spectrum.

For the frequency range most commonly of interest in sound absorption (roughly 100–10,000 Hz), an average cavity depth 116 of between about 0.25 inches (0.6 cm) and about 6 inches (15.2 cm) is common. However, other cavity depths may be selected in order to broaden the sound absorption spectrum. In addition to varying the cavity depth 116, the volume 114 (see FIG. 2) may also be partitioned into separate compartments or subunits. In still other embodiments, a secondary absorbing element such as a fibrous layer, e.g., layer 1026 of FIG. 10F, may be placed adjacent the sound absorber proximate either the exterior surface or the interior surface to further improve the sound absorption spectrum.

Depending on the application, hole spacing or "hole density" preferably ranges from about 100 to about 4,000 holes/square inch, although other densities are certainly possible. The particular hole pattern may be selected as desired. For example, a square array or, alternatively, a staggered array (for example, a hexagonal array) may be used, the latter potentially providing improved tear resistance. In addition to hole density, the actual hole size may also vary depending on the particular application.

FIGS. 3–6 illustrate exemplary perforation configurations according to the present invention. The perforations preferably have a narrowest diameter less than the film thickness 122 (see FIG. 2) and typically less than about 20 mils (0.5 mm). The perforation shape and cross-section may also vary. For instance, the cross-section of the perforation may be circular, square, hexagonal and so forth. For non-circular perforations, the term "diameter" is used herein to refer to the diameter of a circle having the equivalent area as the non-circular cross-section. The microperforation embodiments shown in FIGS. 3–6 are intended to be exemplary, not exhaustive. Accordingly, other configurations are certainly possible without departing from the scope of the invention.

Figure 3:
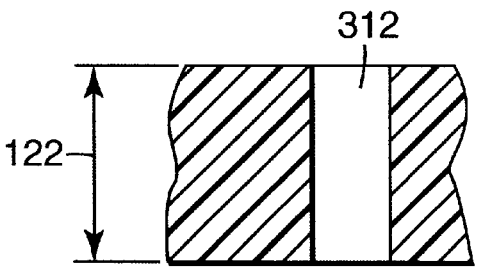
FIG. 3 is a perforation configuration in accordance with one embodiment of the invention.
Figure 4:
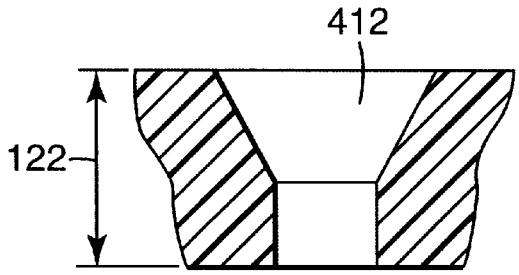
FIG. 4 is a perforation configuration in accordance with another embodiment of the invention.
Figure 5:
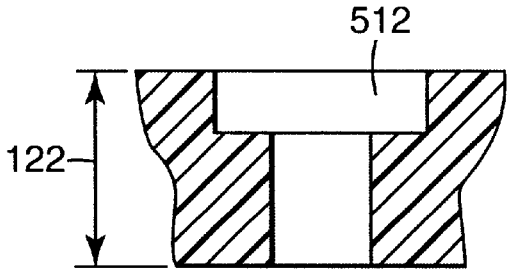
FIG. 5 is a perforation configuration in accordance with yet another embodiment of the invention.
Figure 6:
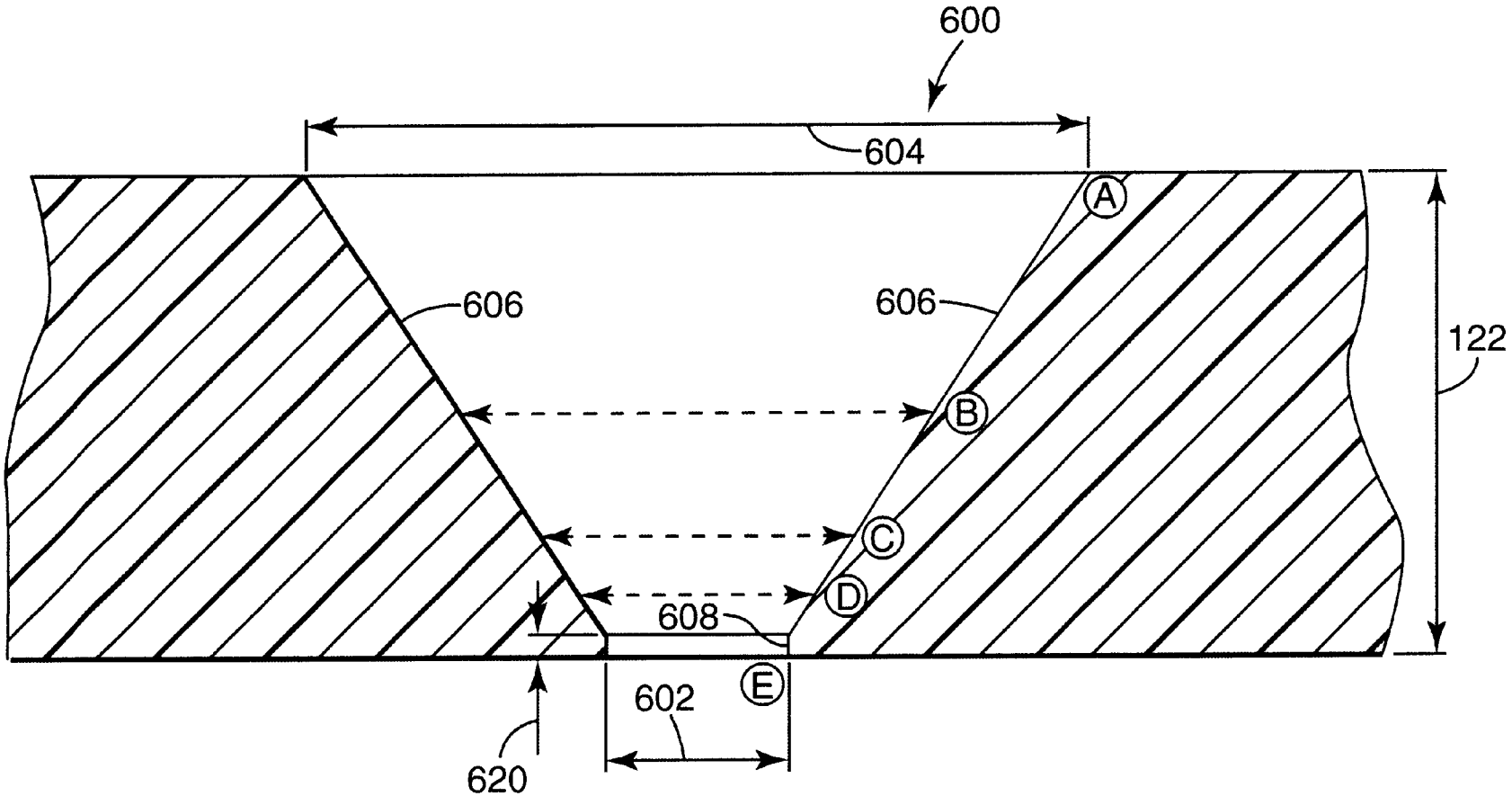
FIG. 6 is a perforation configuration in accordance with still yet another embodiment of the invention.

FIG. 3 illustrates one exemplary microperforation 312 having a relatively constant cross-section over its length. In accordance with another embodiment, FIG. 4 illustrates a microperforation 412 having a varying diameter ranging from a narrowest diameter less than the film thickness 122 to a widest diameter. In still yet another embodiment, FIG. 5 illustrates a counterbored microperforation 512. FIG. 6 illustrates yet another microperforation 600 in accordance with one embodiment of the invention. The hole 600 has tapered edges 606 and includes a narrowest diameter 602 ($d_n$) less than the film thickness 122 ($t_f$) and a widest diameter 604 ($d_w$) greater than the narrowest diameter 602. This provides the hole 600 with an aspect ratio ($t_f$:$d_n$) greater than one and, if desired, substantially greater than one.

Throughout the figures, various embodiments of the microperforations are shown as tapered (see e.g., reference 112 in FIG. 2, reference 600 in FIG. 6). These embodiments are illustrated and described with the widest diameter, e.g., 604 in FIG. 6, facing outwardly (i.e., away from the reflecting surface). However, other embodiments may utilize microperforations that taper in the opposite direction, i.e., the widest diameter faces inwardly or towards the reflecting surface, without significantly impacting the sound absorption characteristics.

Near the narrowest diameter 602, tapered edges 606 form a lip 608. The lip 608 may result from the manufacturing process used to form the microperforation 600. The lip 608, in one embodiment, has a length 620 (l) of about 4 mils (0.1 mm) or less and more often about 1 mil (0.02 mm) over which the average diameter is about equal to the narrowest diameter 602.

The dimensions of the narrowest diameter 602 and widest diameter 604 of the hole 600 can vary, which in turn, affect the slope of the tapered edges 606. As noted above, the narrowest diameter 602 is typically less than the film thickness 122 and may, for example, be about 50% or less or even about 35% or less of the film thickness. In absolute terms, the narrowest diameter may, for example, be about 20 mils (0.5 mm) or less, about 10 mils (0.25 mm) or less, about 6 mils (0.15 mm) or less and even about 4 mils (0.10 mm) or less, as desired. The widest diameter 604 may be less than, greater than, or equal to the film thickness 122. In certain embodiments, the widest diameter ranges from about 125% to about 300% of the narrowest diameter 602.

Figure 7:
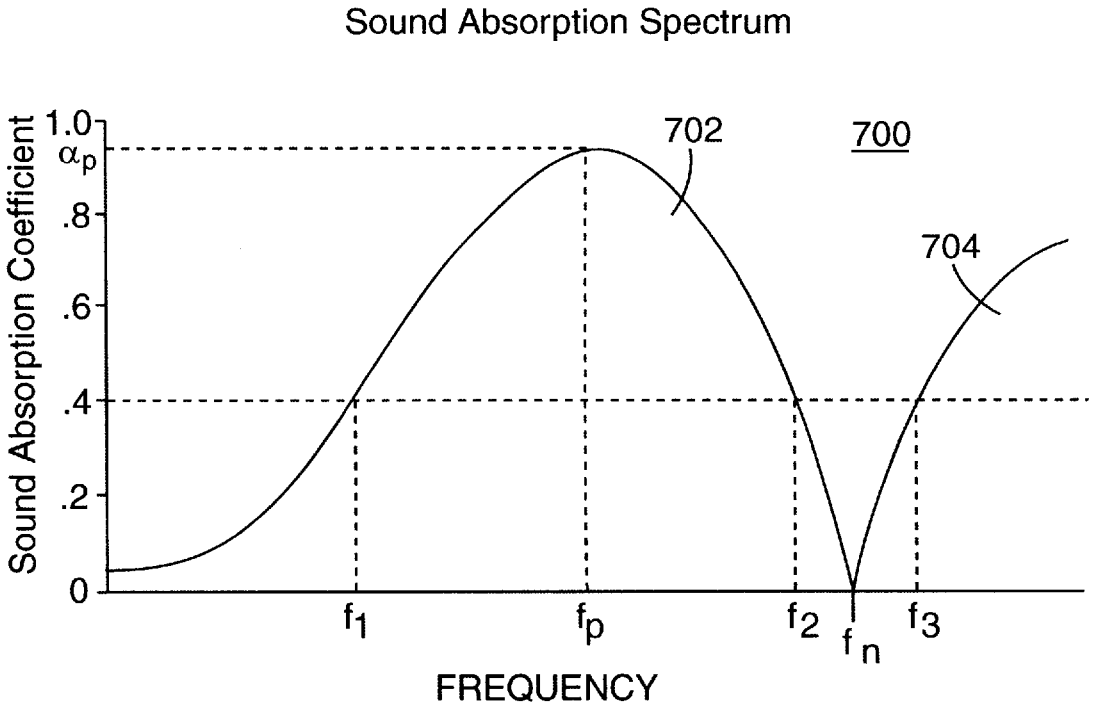
FIG. 7 is a representative normal incidence sound absorption spectrum for a three-dimensional microperforated film sound absorber in accordance with one embodiment of the present invention.

To appreciate the advantages of a microperforation configuration 600 such as that illustrated in FIG. 6, it is helpful to first quantify sound absorption properties. In general, the sound absorption capacity of a sound absorber may be quantified in terms of a sound absorption coefficient $\alpha$. The sound absorption coefficient $\alpha$, may be expressed by the relationship:

$$\alpha(f)=1-A_{ref}(f)/A_{inc}(f)$$

where $A_{inc}(f)$ is the incident amplitude of sound waves at frequency f, and $A_{ref}(f)$ is the reflected amplitude of sound waves at frequency f. FIG. 7 illustrates a representative normal incidence sound absorption spectrum 700. The spectrum generally includes a peak absorption coefficient ($\alpha_p$) at frequency $f_p$ in a primary peak 702, a secondary peak 704, and a nodal frequency $f_n$, forming a primary node between the primary and secondary peaks 702 and 704. At the nodal frequency $f_n$, the absorption coefficient a reaches a relative minimum. The quality or performance of the sound absorption spectrum may be characterized using the frequency range $f_1$, to $f_2$ over which the absorption coefficient $\alpha$ meets or exceeds 0.4 and the frequency range $f_2$ to $f_3$ between the primary peak 702 and secondary peak 704 over which the absorption coefficient a falls below 0.4. Typically, it is desired to maximize the primary peak breadth ratio $f_2/f_1(R_p)$ and minimize the primary node breadth ratio $f_3/f_2(R_n)$.

Due to the higher frictional damping factors associated with smaller hole sizes, as hole diameter decreases, the quality of the sound absorption spectrum generally increases, i.e., $R_p$ increases and $R_n$ decreases. Consequently, with sound absorbers using microperforated sheets, it is desirable to decrease the diameter of the microperforations in order to achieve broad-band sound absorption.

The microperforation 600 of FIG. 6 provides small diameter holes and small hole length in relatively thick films. The providing of high film thickness relative to effective hole length provides several advantages. For instance, the acoustic performance of a short hole length can be combined with the strength and durability of a thick film. This provides several practical benefits. For example, for a straight-wall hole having a length of about 10 mils (0.25 mm) and a diameter of about 4 mil (0.10 mm), an optimum hole spacing (e.g., $\alpha$>0.4 and high $R_p$) is about 20 mils (0.5 mm). This corresponds to a hole density of about 2500 holes per square inch and to a percentage open area based on narrowest hole diameter of about 3%. Using a tapered hole having a narrowest diameter of about 4 mil (0.10 mm) and a lip of about 1 mil (0.03 mm), a sound absorption spectrum essentially equivalent to the above can be obtained with a hole spacing of about 35 mils (0.9 mm). This corresponds to a hole density of about 800 holes per square inch and a percentage open area of about 1%. Thus, for a given sound absorption performance, the much lower hole density allowed by the use of tapered holes may result in more cost-effective manufacturing. Also, the reduced open area may allow the microperforated film to be more effectively used as a barrier to, for example, liquid water, water vapor, oil, dust and debris, and so forth.

Formation of Microperforations in the Film

Although other methods of producing the microperforations are certainly possible (e.g., laser drilling, punching, etc.), an exemplary method in accordance with the present invention is described below.

Figure 8:
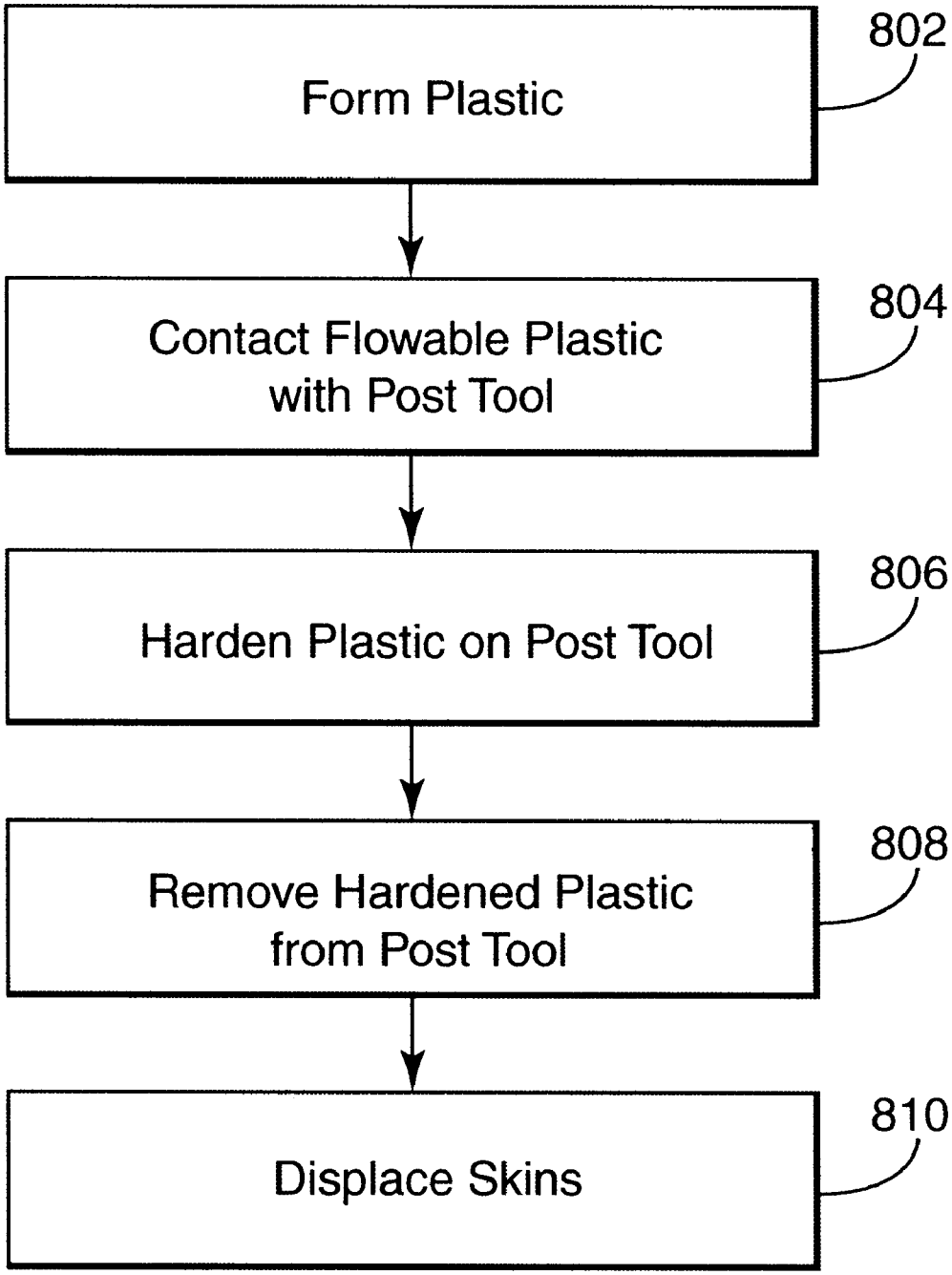
FIG. 8 is a diagrammatic representation of a method used to produce a microperforated plastic film.

Microperforated films in accordance with the present invention may be formed from various materials such as, for instance, polymeric materials. While many types of polymeric materials may be used, e.g., thermoset polymers such as polymers which are cross-linked or vulcanized, a particularly advantageous method of manufacturing a microperforated film utilizes plastic materials. FIG. 8 illustrates an exemplary process for fabricating a microperforated plastic polymer film for use as a sound absorber. Block 802 represents forming a plastic material. This may include selecting the type of plastic and additives, if any. Suitable plastics include, but are not limited to, polyolefins, polyesters, nylons, polyurethanes, polycarbonates, polysulfones, polypropylenes and polyvinylchlorides for many applications. Copolymers and blends may also be used. The type and amount of additives can vary and are typically selected in consideration of the desired sound absorption properties of the film as well as other characteristics of the film, such as color, printability, adherability, smoke generation resistance, heat/flame retardancy and so forth. Additives may, as discussed above, also be added to a plastic to increase its bending stiffness and surface density.

Block 804 represents contacting the embossable plastic material with a tool having posts which are shaped and arranged to form holes in the plastic material which provide the desired sound absorption properties when used in a sound absorber. Embossable plastic material may be contacted with the tool using a number of different techniques such as, for example, embossing, including extrusion embossing, or compression molding. Embossable plastic material may be in the form of a molten extrudate which is brought in contact with the tooling, or in the form of a pre-formed film which is then heated and placed into contact with the tooling. Typically, the plastic material is first brought to an embossable state by heating the plastic material above its softening point, melting point or polymeric glass transition temperature. The embossable plastic material is then brought in contact with the post tool to which the embossable plastic generally conforms. The post tool typically includes a base surface from which the posts extend. The shape, dimensions, and arrangement of the posts are suitably selected in consideration of the desired properties of the holes to be formed in the material. For example, the posts may have a height corresponding to the desired film thickness and have edges which taper from a widest diameter to a narrowest diameter which is less than, the height of the post in order to provide tapered holes, such as the hole, shown in FIG. 6.

Block 806 represents solidifying the plastic material to form a solidified plastic film having holes corresponding to the posts. The plastic material typically solidifies while in contact with the post tool. After solidifying, the solidified plastic film is then removed from the post tool as indicated at block 808. In some instances, the solidified plastic film may be suitable for forming the three-dimensional shapes in accordance with the present invention without further processing. In many instances, however, the solidified plastic film includes a thin skin covering or partially obstructing one or more of the holes. In these cases, as indicated at block 810, the solidified plastic film typically undergoes treatment to displace the skins.

Skin displacement may be performed using a number of different techniques including, for example, forced air treatment, hot air treatment, flame treatment, corona treatment, or plasma treatment. After skin removal, the film is ready for post-forming into three-dimensional shapes as described herein. The film, in one embodiment, has microperforations over substantially all its surface. In other embodiments, the film has microperforations formed over one or more portions of the film surface corresponding to the desired microperforation location after post-forming.

Three-Dimensional Post-Forming of Microperforated Sound Absorbing Films

The sound absorbing film 102 is formed into the three-dimensional shape 104 (see FIG. 1) through post-forming operations. That is, the microperforated film 102 is manufactured as described above or in accordance with other methods and then formed into the desired three-dimensional shape 104 through a forming operation.

Post-forming results in permanent deformation of the microperforated film to produce the self-supporting, three-dimensional shape 104 (see FIG. 1) without the need for separate support frames or fixtures. The deformation typically involves thinning of the film and displacing at least one surface of the film from the planar film shape in which it was manufactured.

Post-forming operations may typically, but not necessarily, employ heat to improve the working qualities of the film. The post-forming processes may also employ pressure (positive or vacuum), molds, etc. to further improve the working qualities of the film, as well as to increase the throughput of the process. For example, one typical post-forming method is thermoforming, including the various forms of vacuum or pressure molding/forming, plug molding, etc. Post-forming may also include stretching films or portions/areas of films in planar directions or stretching the films into non-planar or curved shapes.

Figure 9A:
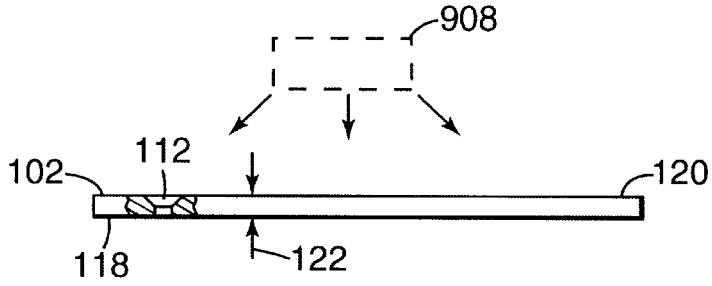
FIGS. 9A–9D are diagrammatic views illustrating a method of producing a three-dimensional sound absorber in accordance with one embodiment of the invention.
Figure 9B:
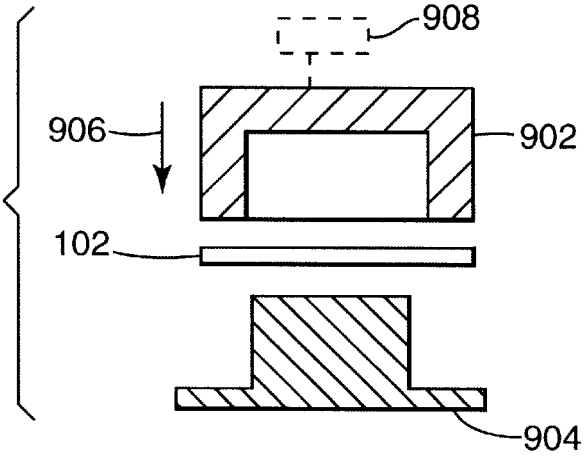

FIG. 9A illustrates a film 102 prior to post-forming in accordance with one embodiment of the invention. The film 102 includes a first major surface 118, a second major surface 120, and a thickness 122. Microperforations 112 extend through the film 102 as shown. FIG. 9B illustrates an exemplary forming mold having surfaces or halves 902 and 904. When the mold halves are closed (e.g., the half 902 is moved in the direction 906), the film 102 is clamped therebetween. As a result, the film 102 is molded to form a sound absorbing body 100 (see FIG. 9C) having the three-dimensional shape 104 similar to that illustrated in FIGS. 1 and 2. A heat source 908 may apply heat to the film 102 prior to molding and/or to the mold halves 902/904 during molding to assist in the forming process.

Figure 9C:
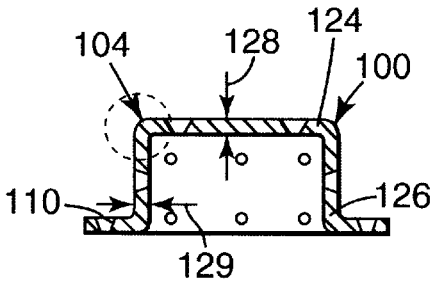
Figure 9D:
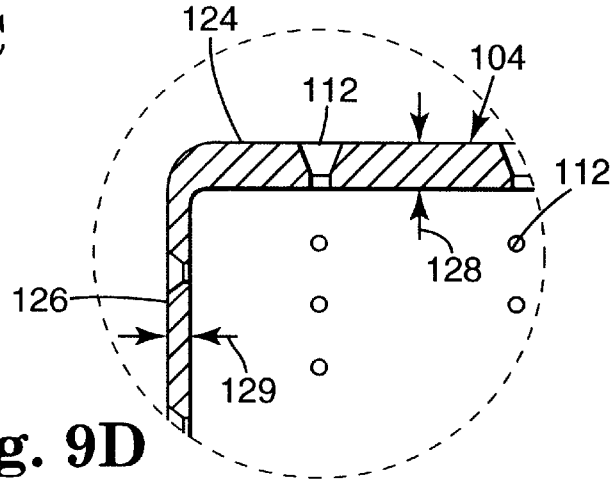

The sound absorbing body 100, in one embodiment, includes a flange 110, a first portion 124, and a second portion 126 as shown in FIG. 9C. During the forming process, the thickness 128 of the first portion 124 remains substantially equal to the original sheet thickness 122 (See FIG. 9A). The thickness 129 of the second portion 126 (see FIG. 9D), on the other hand, is typically reduced during forming. As a result, the thickness of the sheet 102 varies over the three-dimensional shape 104.

While the deformation of the film 102 is illustrated as forming generally planar sections (see FIG. 9C), other drawing molds may also be used. For example, the mold could be spherical such that the three-dimensional shape has a spherical or cylindrical component (see e.g., FIG. 10C).

In another example, the film 102 can be formed to fit and effectively function on most any simple, e.g., regular-shaped, or complex, e.g., irregular-shaped, surface in which it is desired to provide sound absorption. Because most any three-dimensional shape is possible, sound absorbers having relatively complex shapes may be readily produced. In addition, by controlling the cavity depth during forming, the desired sound absorption spectrum may be custom-selected for the particular application.

The deformations illustrated in FIGS. 9A–9D can be characterized by the ratio of the thickness 122 ($t_o$) in the undeformed portions of the film 102 to the thickness 129 ($t_f$) of the deformed portions of the film. Typically, it may be desirable that the ratio $t_o$:$t_f$ be at least about 1.1:1 or greater. In some cases, it is desirable that the ratio $t_o$:$t_f$ be at least about 1.5:1 or greater, more preferably at least about 2:1 or greater.

Thickness variations in the film of post-formed films are, in large part, caused by variations in the strain experienced in different areas of the film during post-forming. In other words, some areas of the post-formed film may experience significant deformation (strain) while other areas may experience little or no deformation during post-forming. Where the film experiences significant deformation, the microperforations 112 (see FIG. 9D) may deform. The deformation, if carefully controlled, may not seriously affect the sound absorbing properties of the film. For instance, a model 4110 densometer produced by Gurley Precision Instruments was used to measure the time required to push about 18 cubic inches (300 cubic centimeters) of air through about a 1 square inch (6.5 square centimeter) area of microperforated film. A Gurley parameter of about 0.7 to about 5.0 seconds has been found to correlate with useful sound absorption in a generally flat (i.e., not post-formed) microperforated film, with the preferred range being about 1.0 to about 2.8 seconds. In one test, a generally flat, microperforated film sample produced in a Gurley parameter of about 2.4 to about 2.8 seconds. After being deformed into a three-dimensional shape similar to that shown in FIG. 10E, the main surface 1018 of the film exhibited a Gurley parameter of about 1.1 to about 1.2 seconds, still within the preferred range. Accordingly, the slight deformation of the microperforations in this instance had little adverse effect on the film's sound, absorbing capabilities. In fact, this example illustrates that it is possible to select the initial, i.e., undeformed, microperforation size so as to allow for most any expansion which might occur during forming. Additionally, if there are regions of the film in which the holes would be overly-deformed, e.g., in areas of high draw ratios such as surface 1020 in FIG. 10E, the microperforation pattern may be selected such that those areas contain few or no microperforations.

Although some specific examples of articles including post-formed films have been described above, it will be understood that post-formed films may be included in any article in which it is desired to take advantage of the unique acoustic and physical properties of such shaped, polymeric films. For example, articles including post-formed films may find use in the automotive industry in door panels, engine compartments, headliners, and similar areas. The articles may also find application in household appliances, e.g., refrigerators, dishwashers, washers, dryers, garbage disposals, HVAC equipment, trash compactors, and the like.

Figure 10A:
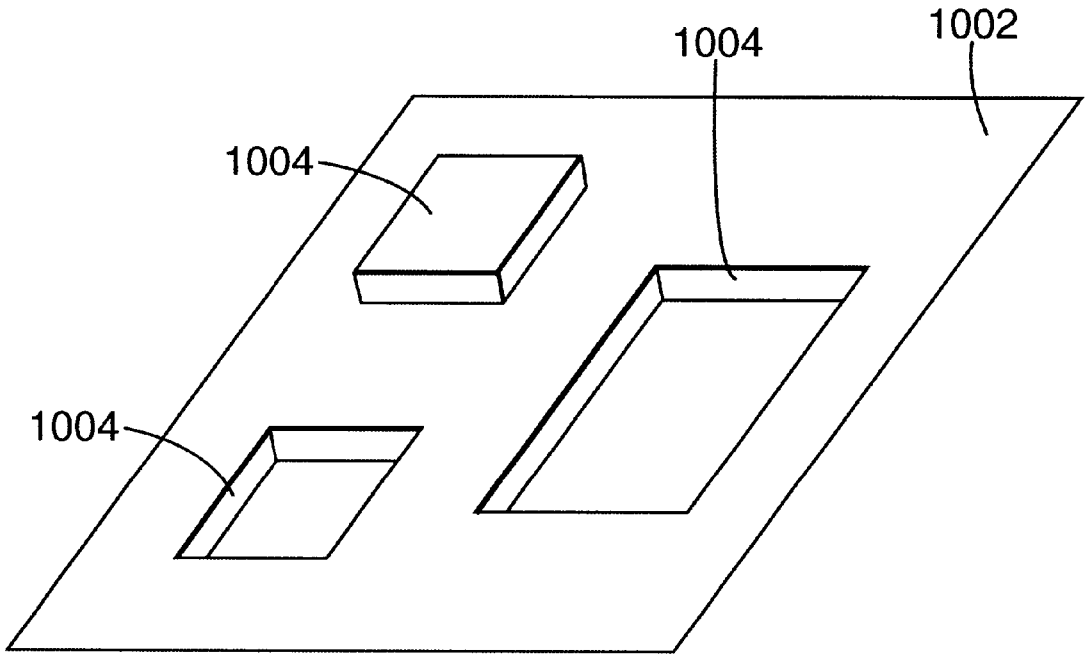
FIGS. 10A–10F illustrate sound absorbers in accordance with other embodiments of the invention.
Figure 10B:
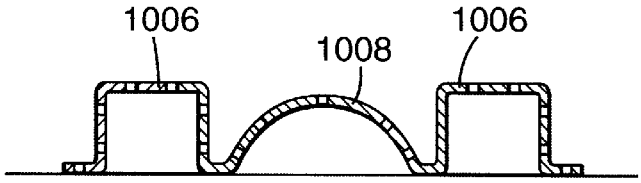
Figure 10C:
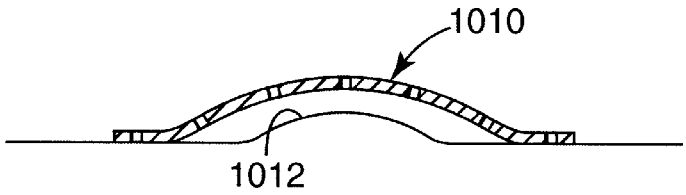
Figure 10D:
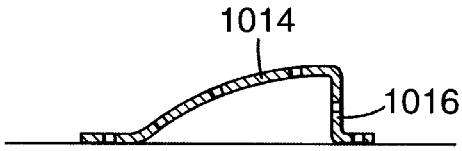
Figure 10E:
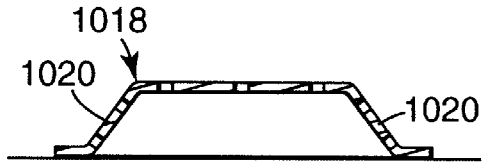

FIGS. 10A–10F illustrate other exemplary three-dimensional shapes that may be produced in accordance with the present invention. FIG. 10A illustrates a film 1002 formed to produce multiple shapes 1004. The shapes may be identical or dissimilar and may be formed on the same or opposite sides as shown. FIG. 10B illustrates a film formed to produce two similar or dissimilar planar shapes 1006 and one non-planar, e.g., spherical, shape 1008. FIG. 10C illustrates a single spherical shape 1010 as used with a curved reflecting surface 1012. FIG. 10D illustrates a film forming a cylindrical portion 1014 and a planar portion 1016. FIG.

Figure 10F:
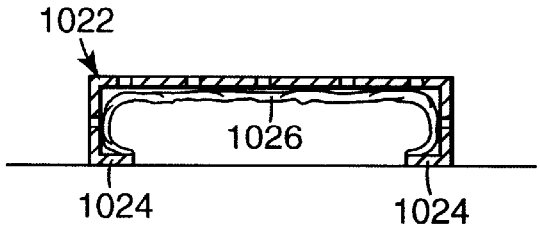

10E illustrates a three-dimensional shape 1018 having sloped side portions 1020. FIG. 10F illustrates a three-dimensional shape 1022 having inwardly facing flanges 1024. FIG. 10F further illustrates the inclusion of a separate insulating layer 1026, e.g., a fibrous sound absorbing material, proximate and, in one embodiment, attached to the interior of the three-dimensional shape 1022. The three-dimensional shape may therefore act as a protective container for the more fragile fibrous material while, at the same time, providing improved sound absorption over absorbers using only fibrous material. The fibrous material 1026 may fill the interior of the three-dimensional shape 1022 partially or completely and may further be configured so as to conform to the three-dimensional shape.

While shown on the interior, other embodiments wherein the fibrous material is located outside the shape 1022 are also possible. Once again, these embodiments are exemplary only and other embodiments are certainly possible without departing from the scope of the invention. For instance, individual elements of the various embodiments described herein may be combined to produce even other sound absorbers.

Attachment to a Reflecting Surface

Referring again to FIG. 2, the three-dimensionally shaped, microperforated polymeric film 102 may be disposed near the reflecting surface 200 in a number of different manners. For example, the film 102 may be attached to the structure which forms the reflecting surface 200. In this case, the film 102 may be attached by its coupling portions, e.g., flanges 110 (see FIG. 2). The film 102 may alternatively be hung, similar to a drape, from a structure near the reflecting surface 200. Regardless, the shaped, microperforated film 102 of the present invention is adapted to span relatively large areas without external support.

Exemplary Performance

Figure 11:
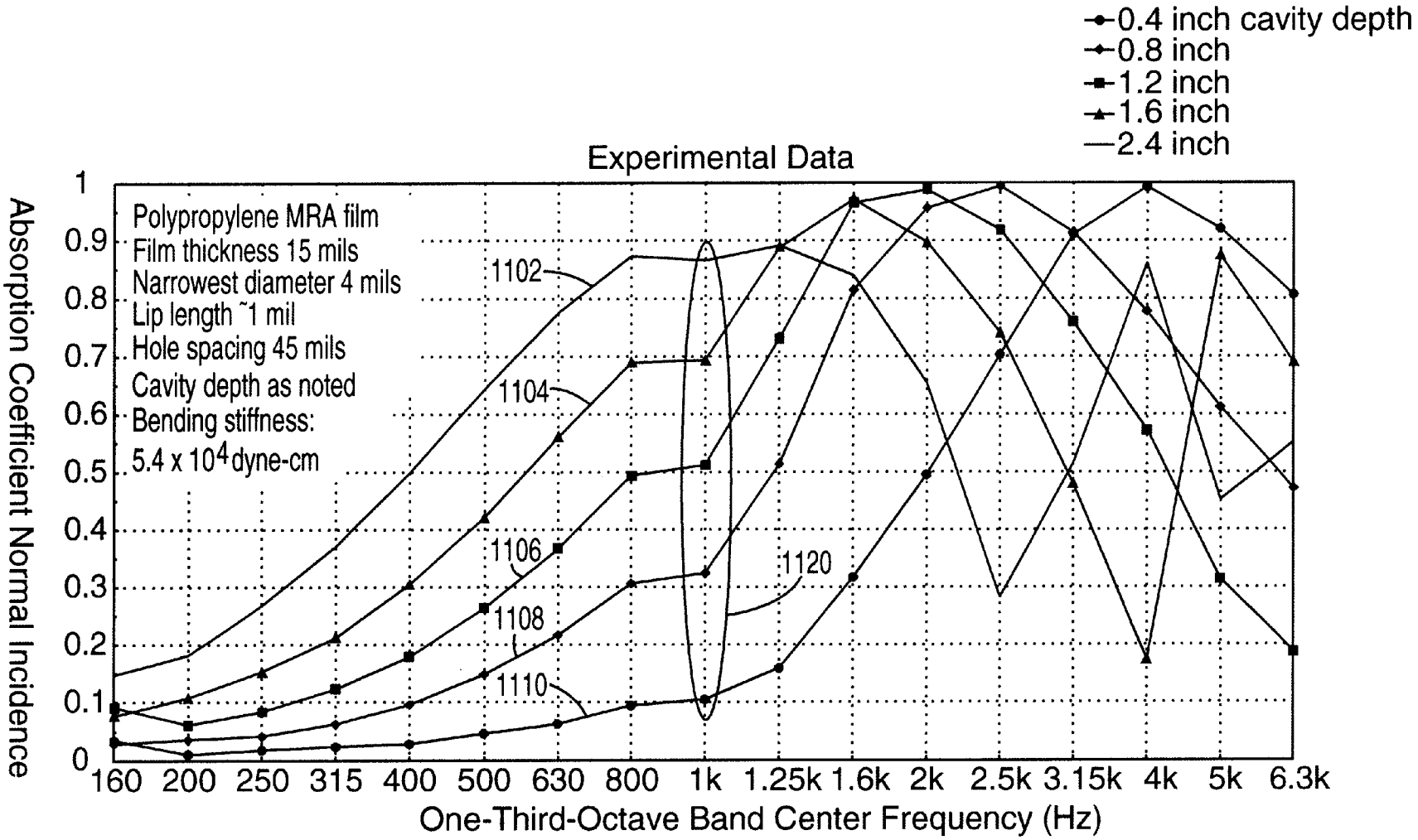
FIG. 11 illustrates exemplary sound absorption spectrums for sound absorbers in accordance with various embodiments of the invention.

FIG. 11 illustrates normal incidence sound absorption coefficient spectrums for a microperforated polypropylene film. In the illustrated embodiment, the film has a bending stiffness of about $5.4\times10^4$ dyne-cm, a film thickness of about 15 mils (0.4 mm), a narrowest diameter of about 4 mils (0.10 mm), a lip length of about 1 mil (0.03 mm) and hole spacing of about 45 mils (1.15 mm). As illustrated in FIG. 11, the sound absorption spectrums 1102–1110 may vary with cavity depth. Also evident in this figure is a discontinuity or "notch" 1120 in the primary peaks of the absorption spectrums 1102–1110. These notches 1120 may occur due to film vibration (i.e., motion of the film resulting from resonant transfer between film kinetic energy and film potential energy from bending) at the film's fundamental resonant frequency, e.g., about 1 kHz. It is believed that the notches 1120 result from the fact that the film motion subtracts slightly from the motion of the air plugs relative to the walls of the microperforations, thus resulting in a slightly reduced absorption coefficient at that frequency.

Nonetheless, FIG. 11 clearly demonstrates that, despite the small anomalous notch attributable to film resonance, the microperforated polypropylene films exhibit excellent sound absorption. For example, the spectrums shown in FIG. 11 have relatively high peak breadth ratios ($R_p$). Moreover, film vibration in response to incident sound typically only affects sound absorption in a specific and limited frequency range (e.g., near the film's resonant frequency) and does not detract from sound absorption over the majority of the frequency range of interest. Thus, films in accordance with the present invention provide relatively broad-band sound absorption despite the existence of the notches 1120.

Thus, while the free spanning portion(s) (i.e., the dimension of the film over which the film is not in contact with an external structure) of the film may vibrate in response to incident sound waves, it has been found that the vibration, if any, fails to significantly impact sound absorption properties. By way of example and not of limitation, suitable free span portions may range from about 100 mils (2.5 mm) on up, with the upper limit being primarily delineated by the surrounding environment.

Conclusion

To provide a more effective sound absorber with minimum degradation of performance, other properties may be altered. For example, film properties such as thickness, bending stiffness, surface density, and loss modulus, as well as boundary conditions such as the extent of the free span can be altered to suit a particular application. It is noted that the relationships between these variables may be complex and interrelated. For example, changing the film thickness may change the bending stiffness as well as the surface density. Accordingly, these variables should be selected taking into account the application and other constraints (for example cost, weight, resistance to environmental conditions, and so on) to arrive at each particular design.

Advantageously, the present invention provides three-dimensionally shaped sound absorbers and methods for forming such sound absorbers. More particularly, the present invention provides for post-forming of sheet-based, microperforated films into most any three-dimensional, self-supporting shape. Accordingly, sound absorbers that conform to non-planar reflecting surfaces or sound absorbers with selectable gaps between the absorber and the reflecting surface can be produced. As discussed above, sound absorbers in accordance with the present invention provide the desired three-dimensional shapes without significantly sacrificing sound absorption properties. This is accomplished even though distortion of the microperforations may occur during post-forming operations.

The complete disclosure of the patents, patent documents, and publications cited herein are incorporated by reference in their entirety as if each were individually incorporated.

Exemplary embodiments of the present invention are described above. Those skilled in the art will recognize that many embodiments are possible within the scope of the invention. Variations, modifications, and combinations of the various parts and assemblies can certainly be made and still fall within the scope of the invention. Thus, the invention is limited only by the following claims, and equivalents thereto.

What is claimed is:

1. A sound absorbing body comprising:

a polymeric film comprising first and second major surfaces;

a plurality of microperforations extending between the first and second major surfaces of the polymeric film; and a three-dimensional shape formed by the polymeric film, the three-dimensional shape comprising an interior surface and an exterior surface, wherein the interior surface defines a volume.

2. The sound absorbing body of claim 1, wherein the polymeric film has a bending stiffness of $10^7$ dyne-cm or less.

3. The sound absorbing body of claim 1, wherein the sound absorbing body comprises one or more substantially planar elements.

4. The sound absorbing body of claim 1, wherein the sound absorbing body comprises one or more non-planar elements.

5. The sound absorbing body of claim 1, further comprising a reflecting surface facing the interior surface of the three-dimensional shape, wherein the volume is further defined by the reflecting surface.

6. The sound absorbing body of claim 5, wherein the reflecting surface is substantially planar.

7. The sound absorbing body of claim 5, wherein the reflecting surface is non-planar.

8. The sound absorbing body of claim 5, wherein the sound absorbing body is proximate the reflecting surface.

9. The sound absorbing body of claim 5, wherein the sound absorbing body is attached to the reflecting surface.

10. The sound absorbing body of claim 5, wherein the sound absorbing body is semi-permanently attached to the reflecting surface.

11. The sound absorbing body of claim 1, wherein the thickness of the polymeric film varies over the three-dimensional shape.

12. The sound absorbing body of claim 1, wherein one or more of the plurality of microperforations has a diameter which varies between the first major surface and the second major surface.

13. The sound absorbing body of claim 1, wherein the film has sufficient stiffness to maintain the three-dimensional shape.

14. The sound absorbing body of claim 1, wherein a plurality of three-dimensional shapes are formed in a substantially unitary polymeric film.

15. The sound absorbing body of claim 1, wherein a plurality of substantially uniform three-dimensional shapes are formed in a substantially unitary polymeric film.

16. The sound absorbing body of claim 1, wherein a plurality of different three-dimensional shapes are formed in a substantially unitary polymeric film.

17. The sound absorbing body of claim 16, wherein the plurality of different three-dimensional shapes vary in size.

18. The sound absorbing body of claim 16, wherein the plurality of different three-dimensional shapes vary in shape.

19. The sound absorbing body of claim 16, wherein the plurality of different three-dimensional shapes vary in size and shape.

20. The sound absorbing body of claim 1, wherein at least one of the plurality of microperforations has a narrowest diameter less than a thickness of the polymeric film at its thickest portion.

21. The sound absorbing body of claim 1, wherein a majority of the plurality of microperforations are tapered between the first and second major surfaces of the polymeric film.

22. The sound absorbing body of claim 1, wherein a majority of the plurality of microperforations are tapered between the first and second major surfaces of the polymeric film, and wherein each of the tapered microperforations has a narrowest diameter less than a thickness of the polymeric film at its thickest portion.

23. The sound absorbing body of claim 1, wherein the microperforations comprise a narrowest diameter of about 20 mils or less.

24. The sound absorbing body of claim 1, wherein the plurality of microperforations are arranged in a pattern comprising a density of about 100 to about 4000 per square inch.

25. A sound absorbing body comprising:

a polymeric film comprising first and second major surfaces;

a plurality of microperforations extending between the first and second major surfaces of the polymeric film; and a three-dimensional shape formed by the polymeric film, the three-dimensional shape comprising an interior surface and an exterior surface, wherein the interior surface defines a volume of the three-dimensional shape, and further wherein, in response to incident soundwaves at a particular frequency in the audible frequency spectrum, the sound absorbing body absorbs at least a portion of the incident soundwaves, and further wherein at least a portion of the three-dimensional shape vibrates in response to the incident soundwaves.

26. The sound absorbing body of claim 25, wherein the particular frequency is a fundamental resonant frequency of the polymeric film with the microperforations formed therein.

27. The sound absorbing body of claim 25, wherein the sound absorbing body has a sound absorption coefficient of 0.4 or greater at the fundamental resonant frequency.

28. The sound absorbing body of claim 25, wherein the three-dimensional shape comprises one or more curvilinear surfaces.

29. The sound absorbing body of claim 25, wherein the three-dimensional shape comprises a smooth, continuous surface.

30. The sound absorbing body of claim 25, wherein the three-dimensional shape comprises one or more planar surfaces.

31. The sound absorbing body of claim 25, wherein the sound absorbing body is proximate a reflecting surface which further defines the volume.

32. The sound absorbing body of claim 31, wherein the three-dimensional shape further comprises coupling portions for coupling the three-dimensional shape to the reflecting surface.

33. The sound absorbing body of claim 25, wherein the plurality of microperforations are formed over substantially all of the three-dimensional shape.

34. The sound absorbing body of claim 25, wherein the plurality of microperforations are formed over a portion of the three-dimensional shape.

35. A sound absorbing body comprising:

a polymeric film comprising first and second major surfaces;

a plurality of microperforations extending between the first, and second major surfaces of the polymeric film;

a three-dimensional shape formed by the polymeric film, the three-dimensional shape comprising an interior surface and an exterior surface, wherein the interior surface defines a volume of the three-dimensional shape; and fibrous sound absorbing material proximate the polymeric film.

36. The sound absorbing body of claim 35, wherein the fibrous sound absorbing material is attached to the polymeric film.

37. The sound absorbing body of claim 35, wherein the fibrous sound absorbing material is located within the volume defined by the interior surface of the three-dimensional shape.

38. The sound absorbing body of claim 35, wherein the fibrous sound absorbing material is coupled to the polymeric film.

39. A method of manufacturing a sound absorbing body comprising:

providing a sheet of polymeric film comprising first and second major surfaces, the polymeric film comprising a plurality of microperforations extending between the first and second major surfaces of the polymeric film; and deforming the sheet to form a three-dimensional shape, the three-dimensional shape comprising an interior surface and an exterior surface, wherein the interior surface defines a volume of the three-dimensional shape.

40. The method of claim 39, wherein the deforming comprises heating the sheet of polymeric film.

41. The method of claim 39, wherein the deforming comprises forcing the sheet of polymeric film against a mold surface.

42. The method of claim 39, wherein the deforming comprises heating the sheet of polymeric film and forcing the sheet of polymeric film against a mold surface.

43. The method of claim 39, wherein the deforming comprises heating the sheet of polymeric film and forcing the sheet of polymeric film against a mold surface after heating the sheet.

44. The method of claim 39, wherein the deforming comprises forcing the sheet of polymeric film against a heated mold surface.

45. The method of claim 39, wherein the deforming comprises forming a plurality of the three-dimensional shapes in the sheet of polymeric film.

46. The method of claim 39, further comprising attaching a reflecting surface to the sheet of polymeric film after the deforming, the reflecting surface facing the interior surface of the three-dimensional shape, wherein the volume defined by the interior surface of the three-dimensional shape is further defined by the reflecting surface.

47. The method of claim 46, wherein the reflecting surface is substantially planar.

48. A sound absorbing body comprising:

a polymeric film comprising first and second major surfaces;

a plurality of microperforations extending between the first and second major surfaces of the polymeric film; and a three-dimensional shape formed by the polymeric film, the three-dimensional shape comprising an interior surface and an exterior surface, wherein the interior surface defines a volume of the three-dimensional shape, and further wherein, in response to incident soundwaves at a particular frequency in the audible frequency spectrum, the sound absorbing body absorbs at least a portion of the incident soundwaves, and further wherein at least a portion of the three-dimensional shape vibrates in response to the incident soundwaves, and still further wherein the sound absorbing body operates to cause a normal incidence sound absorption spectrum to exhibit a notch.

49. The sound absorbing body of claim 48, wherein the particular frequency is a fundamental resonant frequency of the polymeric film with the microperforations formed therein.

50. The sound absorbing body of claim 49, wherein the sound absorbing body has a sound absorption coefficient of 0.4 or greater at the fundamental resonant frequency.

51. The sound absorbing body of claim 48, wherein the three-dimensional shape comprises one or more curvilinear surfaces.

52. The sound absorbing body of claim 48, wherein the three-dimensional shape comprises a smooth, continuous surface.

53. The sound absorbing body of claim 48, wherein the three-dimensional shape comprises one or more planar surfaces.

54. The sound absorbing body of claim 48, wherein the sound absorbing body is proximate a reflecting surface which further defines the volume.

55. The sound absorbing body of claim 54, wherein the three-dimensional shape further comprises coupling portions for coupling the three-dimensional shape to the reflecting surface.

56. The sound absorbing body of claim 48, wherein the plurality of microperforations are formed over substantially all of the three-dimensional shape.

57. The sound absorbing body of claim 48, wherein the plurality of microperforations are formed over a portion of the three-dimensional shape.

* * * * *